United States Patent [19]

Caldwell et al.

[11] Patent Number: 4,464,238

[45] Date of Patent: Aug. 7, 1984

[54] POROUS SEPARATORS FOR ELECTROLYTIC PROCESSES

[75] Inventors: Donald L. Caldwell; Kenneth A. Poush, both of Lake Jackson, Tex.

[73] Assignee: The Dow Chemical Company, Midland, Mich.

[21] Appl. No.: 492,977

[22] Filed: May 9, 1983

[51] Int. Cl.[3] ..... C25B 1/14; C25B 1/00; C25B 13/00

[52] U.S. Cl. ..... 204/98; 204/128; 204/252; 204/295

[58] Field of Search ..... 204/296, 98, 128, 252, 204/295

[56] References Cited

U.S. PATENT DOCUMENTS

| | | | |
|---|---|---|---|
| 1,865,152 | 6/1932 | Stuart | 204/295 X |
| 3,505,200 | 4/1970 | Grotheer | 204/295 |
| 3,694,281 | 9/1972 | Leduc | 204/295 X |
| 3,989,615 | 11/1976 | Kiga et al. | 204/296 |
| 4,154,666 | 5/1979 | Patil et al. | 204/283 |

FOREIGN PATENT DOCUMENTS

| | | | |
|---|---|---|---|
| 795724 | 8/1973 | Belgium | 204/296 |
| 2604975 | 8/1976 | Fed. Rep. of Germany | 204/296 |

*Primary Examiner*—John F. Niebling
*Attorney, Agent, or Firm*—W. J. Lee

[57] ABSTRACT

Porous separators for electrolytic processes are designed which are characterized by an $N_{mac}t$ value, where $N_{mac}$ is the ratio of the resistance (r) of the electrolyte-saturated separator to the resistance ($r_o$) of an equivalent volume of electrolyte and t is the thickness, in inches, of the separator. The $N_{mac}$ value is referred to here as the MacMullin Number.

5 Claims, 3 Drawing Figures

POROUS SEPARATORS FOR ELECTROLYTIC PROCESSES

BACKGROUND OF THE INVENTION

The diaphragm is the key to the efficient operation of a diaphragm chlorine cell. Although the development of novel electrode materials has resulted in marked improvements in cell voltage and operating life during the past decade, diaphragm technology has not advanced materially since the invention of the deposited asbestos diaphragm fifty years ago. Additional major increases in cell energy efficiency, which depends both on cell voltage and current efficiency, must await significant diaphragm improvements.

The preparation of commercial chlorine cell diaphragms remains more art than science. Although recipes that yield good results have been developed over the years, improvements have normally been obtained only as the result of tedious, trial-and-error experimentation. One reason is the absence of suitable characterizing parameters. Equation (1) defines what we call here the "MacMullin Number" ($N_{mac}$), or resistance ratio. To the best of our knowledge this is the first time that this parameter has been used for designing porous cell separators.

Several authors have discussed the theoretical aspects of diaphragm structure and characterization. See, e.g., D. L. Caldwell, "Production of Chlorine", in *COMPREHENSIVE TREATISE OF ELECTROCHEMISTRY,* Vol, 2, Plenum Press, 1981, pp. 108–166; and F. Hine, "Diaphragm Engineering in Sodium Chloride Electrolysis", in *SODA TO ENSO,* June, 1980, pp. 219–233. Theoretical models have also appeared in the literature; e.g., W. H. Koh, "Model Optimization of Diaphragm Performance in Industrial Chlor-Alkali Cells", *A.I.Ch.E. SYMP. SERIES* 77, No. 204 (1981), pp. 213–217. None of these authors, however, either teach or imply the discovery that a direct relationship exists between the cell operating variables and the $N_{mac}t$ value (described hereinafter) yielding the lowest specific energy consumption per cell; and, further, that $N_{mac}t$ values are readily determined experimentally.

U.S. Pat. No. 4,250,002 claims a cell separator as defined by a complex algebraic expression relating current efficiency to pore size distribution. Not only is this expression difficult to apply in practice, but the authors apparently fail to realize that minimum energy consumption requires the simultaneous consideration of both current efficiency and separator voltage drop. Since these factors tend to work counter to one another, a distinct optimum separator configuration will exist. This realization is at the heart of the present invention, and was not anticipated by U.S. Pat. No. 4,250,002.

SUMMARY OF THE INVENTION

The invention herein disclosed is a method for improving the energy efficiency of electrolytic devices which utilize porous separators. The improvement is effected by specifying a value for a structural parameter, which we call the MacMullin Number, which results in the minimum total electrical energy consumption for the electrolytic device.

The MacMullin Number, $N_{mac}$, is defined as the ratio of the electrical resistance of an electrolyte-saturated porous medium, r, to the resistance of an equivalent volume of electrolyte, $r_o$; i.e., $$N_{mac}=r/r_o \tag{1}$$

The MacMullin Number is a measure of resistance to movement of ions. The product of MacMullin Number and thickness defines an effective path length for ionic transport through the separator. The MacMullin Number appears explicitly in the one-dimensional dilute solution flux equations which govern the movement of ionic species within the separator; it is of practical utility because of the ease with which it is determined experimentally.

The electrical energy consumption of an electrolytic device increases with increasing cell voltage and decreasing current efficiency. For example, the specific energy consumption of a chlor-alkali cell is determined as follows:

$$\frac{dc\ \text{kWh}}{mt\ \text{NaOH}} = \frac{670.10 \times E_{cell}}{\eta_{current}} \tag{2}$$

where $E_{cell}$ is the total cell voltage and $\eta_{current}$ is the fraction of total cell current producing NaOH which exits the cell as product.

It has now been found, unexpectedly, that a unique value for the product of MacMullin Number and thickness ($N_{mac}t$) exists which yields the minimum specific energy consumption for any given set of cell operating parameters. Values of $N_{mac}t$ greater than the optimum result in an increased voltage and an increased energy consumption. Values of $N_{mac}t$ smaller than the optimum result in a decreased current efficiency and increased energy consumption.

The invention is illustrated by, but not limited to, application in hydraulically-permeable diaphragm chlor-alkali cells. In the specific case the diaphragm $N_{mac}t$ for minimum energy consumption for caustic production is found by the relationship:

$$N_{mac}t=0.0782-0.5965I+0.8367\ \ln(I)+0.0021\text{-}75A+2.25\times10^{-5}B+0.006737C-0.009438D-2.\text{-}862\times10^{-5}E-1.684\times10^{-5}F \tag{3}$$

Where $N_{mac}t=(N_{mac})\times(t)$ for minimum energy consumption for caustic production: (in)

I=current density: (amps/in$^2$)

A=brine feed concentration: (G/L NaCl)

B=(caustic effluent concentration)$^2$: (G/L NaOH)×(G/L NaOH)

C=(caustic effluent concentration)×I

D=(caustic effluent concentration)×ln (I)

E=(caustic effluent concentration)×A

F=(caustic effluent concentration) (cell temp.): (G/L NaOH)×(°C.)

DETAILED DESCRIPTIONS

FIG. 1 depicts a generalized view of a test cell for measuring properties of a diaphragm in determining the MacMullin Number. A cell body (1) is divided into two compartments by a divider (2), the divider (2) having an opening (3) across which a diaphragm test specimen (5)

Figure 1:
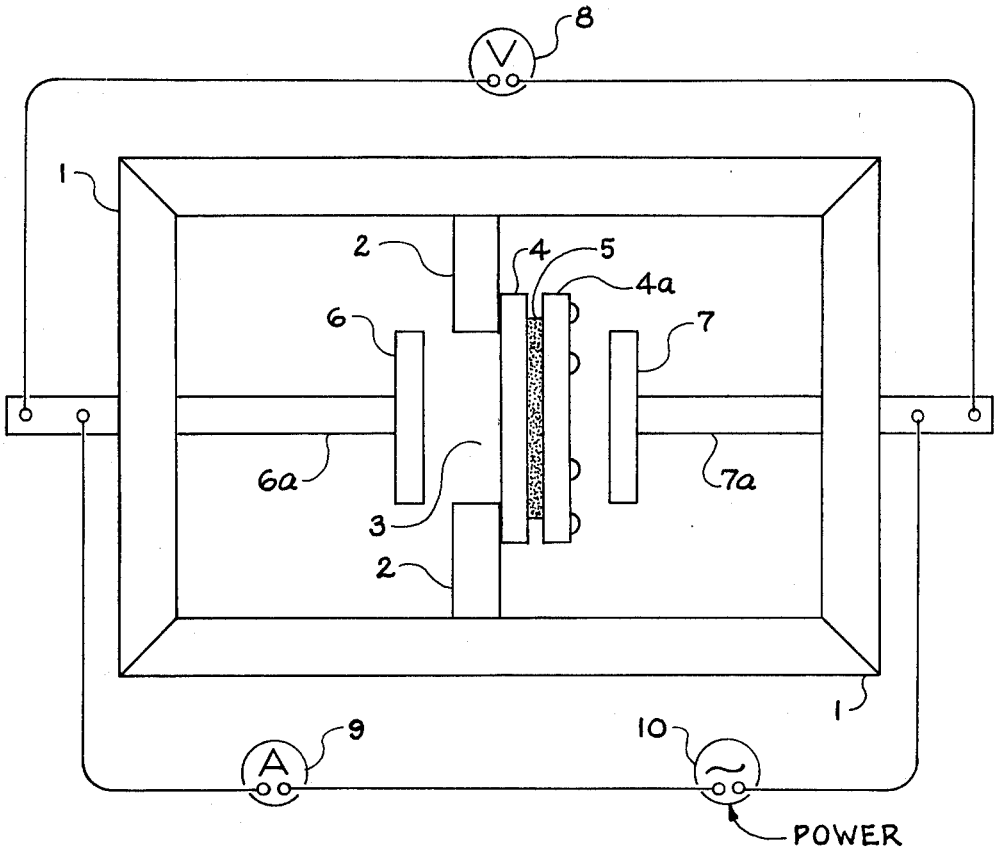
FIGS. 1 and 2 are illustrations useful as visual aids in describing certain features of the invention described and claimed.

is held in place between two "window-frame" type holders (4 and 4a). In one of the cell compartments there is an anode means (6) and in the other cell compartment there is a cathode means (7). A conductor means (6a) is provided for connection of anode (6) to an AC high frequency power supply (10) and a conductor means (7a) is provided for connection of cathode (7) to the power supply. Appropriate electrolytes (not shown) are provided in the so-formed "anolyte" and "catholyte" portions of the cells. A voltmeter (8) is connected by conductor wires to conductor means (6a) and (7a). An ammeter (9) and high frequency signal generator (10) are connected in series to each other, but in parallel to voltmeter (9) by conductor wires to conductor means (6a) and (7a).

Figure 2:
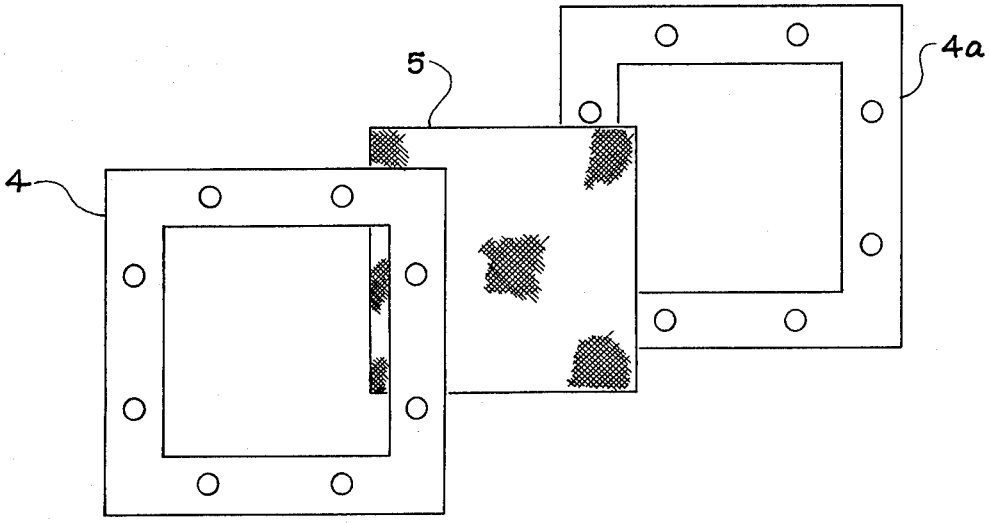

FIG. 2 depicts an enlarged, exploded illustration of diaphragm (5) between holding frames (4) and (4a), these being in reference to the same-numbered members of FIG. 1.

The procedure of employing the test cell of FIG. 1 is as outlined here:

1. soak the diaphragm in saturated brine for about 16–24 hours;

2. measure the standard resistance ($r_1$) of the test cell without the diaphragm, but with the "window frame" holder in place;

3. assemble the soaked diaphragm, still wet, into the holder and position it in the cell;

4. measure the resistance ($r_2$) with the diaphragm in place;

5. calculate $N_{mac}$ from equation (4).

In general, the present inventive process comprises:

(a) establish desired operating parameters for electrolytic process utilizing porous separator;

(b) calculate $N_{mac}t$ value for process at the specified conditions;

(c) prepare porous separator characterized by the calculated $N_{mac}t$ value;

(d) install the porous separator in the electrolytic device.

In an alternate embodiment, given a separator with fixed $N_{mac}t$ value, this method can be used to calculate values of the operating parameters necessary to give minimum specific energy consumption.

Whereas permeable asbestos diaphragms, as porous separators, have been historically popular for many years, there has been considerable effort in recent years to find suitable replacements for asbestos, such as other mineral fibers, polymers, resins, and the like. The present inventive concept is not dependent on the separator being made of asbestos or any other particular material and is envisioned as being applicable to all porous separators.

EXPERIMENTAL DETERMINATION OF MACMULLIN NUMBER

FIG. 1 shows the apparatus needed for an accurate measurement. Counter electrodes are positioned on either side of the diaphragm window and a resistance measurement ($r_1$) is made of the vessel filled with saturated brine but without the diaphragm. The diaphragm is inserted and the increased resistance is used to calculate the MacMullin Number:

$$N_{mac} = \frac{r_2 - r_1}{r_o} + 1 \quad (4)$$

Where $r_2$ and $r_1$ are experimental values with and without the diaphragm and $r_o$ is a calculated blank resistance.

Thickness is used to calculate $r_o$, the equivalent resistance of the electrolyte occupied by the diaphragm:

$$r_o = \rho \frac{t}{A}, \text{ where } \rho \text{ is the resistivity of the measurement electrolyte, } t \text{ is thickness, and } A \text{ is area in in}^2. \quad (5)$$

The resistivity of saturated brine at 25° C. is 1.58 Ω-inch so that a diaphragm of area 2"×2" has a blank resistance in the test cell of:

$$r_o = 0.396t \quad (6)$$

The reproducibility in computing the MacMullin number is estimated to be ±15%. A source of error is in the wettability or degassing during the measurement. The problem becomes aggravated by polymer-modified diaphragms which have a high hydrophobicity.

For diaphragm cell chlor-alkali production $N_{mac}t$ calculated by equation (3) should be maintained within ±25% for minimum energy consumption.

The following examples illustrate the invention, but the invention is not limited to the examples shown.

EXAMPLES

Seven laboratory chlorine cells were used in the study. A two-level factorial experiment was planned, with current, HCl feed, concentration, NaOH product concentration, $N_{mac}$ and t as the independent variables. The experiments were randomized and twenty-two response variables were measured at each set of conditions. The seven asbestos diaphragms, each 3.75×3.75 in., were prepared from four batches of slurry. MacMullin Number, thickness, and air permeability data for the seven diaphragms are presented in Table 1.

The laboratory cells were operated by controlling the differential head, current density, and acid concentration in the feed brine. The cell temperature was held constant during the tests. Electrode materials were identical in all cells.

A total of 14 data sets was obtained and analyzed statistically for relationships between the diaphragm measurements and cell performance. It was concluded that the cell current efficiencies, diaphragm voltage drop, anolyte pH, and anolyte dissolved chlorine concentrations can be calculated as functions of current, feed brine HCl concentration, head, and two diaphragm bulk properties, thickness and MacMullin Number. The product of thickness and MacMullin Number was the diaphragm variable combination which proved most effective in improving the least-squares data fit.

Table 2 presents typical operating data for the seven cells. The optimum $N_{mac}t$ value and resulting specific energy consumption calculated by the method of the present invention are also shown in Table 2. The cell voltages are calculated in all cases by the expression:

$$E_{cell} = 2.5 + 0.5\,(I - 0.3) + E_{dia} \quad (7)$$

Where $E_{dia}$ is the diaphragm IR drop.

It is apparent that use of the present invention to optimize the diaphragm will result in appreciable energy savings.

Figure 3:
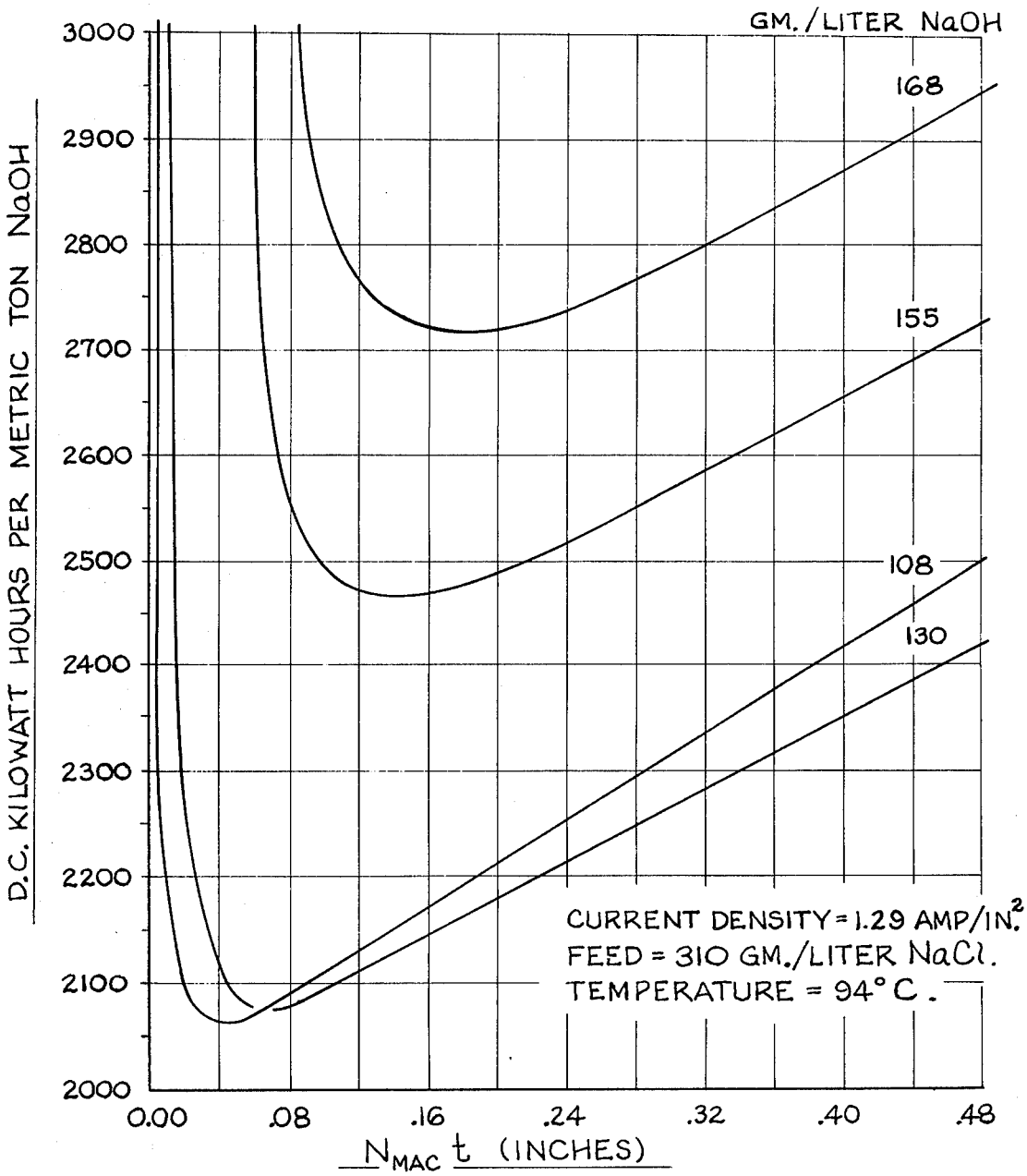
FIG. 3 is a graph showing a family of curves based on data described hereinafter.

FIG. 3 is illustrative of the invention. It shows the sharp minimum in specific energy consumption as a function of $N_{mac}t$ value at fixed current density, brine feed concentration, and cell temperature, caustic effluent concentration being treated as a parameter.

TABLE 1

| MODEL STUDY DIAPHRAGM PROPERTIES | | | |
|---|---|---|---|
| DIAPHRAGM | LIQUID PERMEABILITY ($in^2 \times 10^{-10}$) | THICKNESS (in) | $N_{mac}$ |
| A | 0.232 | .066 | 3.45 |
| B | 0.288 | .061 | 5.15 |
| C | 0.181 | .128 | 7.45 |
| D | 0.701 | .071 | 5.30 |
| E | 0.518 | .067 | 3.30 |
| F | 0.378 | .110 | 4.85 |
| G | 0.233 | .119 | 7.50 |

TABLE 2

| COMPARISON OF EXPERIMENTAL AND OPTIMIZED VALUES | | | | | | | | | |
|---|---|---|---|---|---|---|---|---|---|
| OPERATING CONDITIONS | | | | | EXPERIMENTAL VALUES | | OPTIMIZED VALUES | | |
| Dia. | Brine Feed Conc. G/L NaCl | Caustic Effluent Conc. G/L NaOH | Current Density $A/in^2$ | Cell Temp. °C. | $N_{mac}t$ in | Energy dckWh mt NaOH | $N_{mac}$ in | Energy dckWh mt NaOH | Δ (ENERGY) % |
| A | 302.2 | 99.4 | .6 | 70 | .228 | 1893 | .077 | 1849 | −2.3 |
| | 303.0 | 80.6 | .6 | 70 | | 1929 | .019 | 1828 | −5.2 |
| B | 297.0 | 107.2 | .3 | 70 | .314 | 2149 | .194 | 1754 | −18.3 |
| | 302 | 102.1 | .3 | 70 | | 1928 | .147 | 1864 | −3.3 |
| C | 297.0 | 111.4 | .6 | 70 | .954 | 2256 | .127 | 1874 | −1.7 |
| | 311.5 | 131.0 | .3 | 70 | | 2118 | .387 | 2009 | −5.2 |
| D | 303.0 | 93.8 | .3 | 70 | .376 | 2026 | .080 | 1730 | −1.5 |
| | 308.7 | 130.8 | .6 | 70 | | 2470 | .199 | 2120 | −1.4 |
| E | 304.0 | 111.0 | .6 | 70 | .221 | 2210 | .119 | 1863 | −1.6 |
| | 304.3 | 136.6 | .6 | 70 | | 2145 | .235 | 2140 | −0.2 |
| F | 304.0 | 102.7 | .6 | 70 | .534 | 2032 | .087 | 1853 | −8.8 |
| | 299.4 | 94.9 | .6 | 70 | | 2128 | .063 | 1968 | −7.5 |
| G | 302.2 | 119.6 | .6 | 70 | .893 | 2101 | .157 | 2006 | −4.3 |
| | 304.0 | 109.9 | .6 | 70 | | 2147 | .114 | 1862 | −13.3 |
| | | | | | AVERAGE ENERGY SAVINGS (%): | | | | −5.3 |

We claim:

1. A method for designing a porous separator for use in an electrolytic process cell, said method comprising,
   (a) establishing the desired operating parameters for the electrolytic process in which the porous separator is to be installed,
   (b) calculating the $N_{mac}t$ value for the separator at the process conditions established in (a) above,
   (c) preparing a porous separator characterized by the calculated $N_{mac}t$ value of (b) above, and
   (d) installing the so-prepared porous separator in the electrolytic process cell, said $N_{mac}t$ value representing the product of the MacMullin Number ($N_{mac}$) times the thickness in inches (t) of the porous separator, said $N_{mac}$ number being computed from the formula $$N_{mac}=r/r_o$$

wherein r is the value for the resistance of the electrolyte-saturated separator, and $r_o$ is the value of the resistance of equivalent volume of electrolyte.

2. The method of claim 1 wherein the electrolytic process cell comprises a chlor-alkali cell wherein caustic and chlorine are produced by electrolysis of aqueous alkali metal halide.

3. The method of claim 1 wherein the porous separator comprises a hydraulically-permeable asbestos diaphragm.

4. The method of claim 1 wherein the electrolytic process cell comprises a chlor-alkali cell in which aqueous NaCl is electrolyzed and wherein the porous separator comprises a hydraulically-permeable asbestos diaphragm.

5. The method of claim 1 wherein the electrolytic process cell comprises a chlor-alkali cell in which aqueous NaCl is electrolyzed to produce chlorine and caustic soda, and wherein said $N_{mac}t$ value is computed by the formula $$N_{mac}t=0.0782-0.5965I+0.8367\ \ln(I)+0.0021\text{-}75A+2.25\times10^{-5}B+0.006737C-0.009438D-2.\text{-}862\times10^{-5}E-1.684\times10^{-5}F$$

where $N_{mac}t=(N_{mac})\times(t)$ for minimum energy consumption for caustic production: (inches)

I=current density: (amps/$in^2$)

A=brine feed concentration: (G/L NaCl)

B=(caustic effluent concentration)$^2$: (G/L NaOH)$^2$

C=(caustic effluent concentration)×I

D=(caustic effluent concentration)×ln (I)

E=(caustic effluent concentration)×A

F=(caustic effluent concentration) (cell temperature): (G/L NaOH)×(°C.).

* * * * *

UNITED STATES PATENT AND TRADEMARK OFFICE

CERTIFICATE OF CORRECTION

PATENT NO. : 4,464,238

DATED : August 7, 1984

INVENTOR(S) : Donald L. Caldwell and Kenneth A. Poush

It is certified that error appears in the above—identified patent and that said Letters Patent is hereby corrected as shown below:

Table 2, column 5 and 6, Optimized Values, "$N_{mac}$", should read --$N_{mac}t$--

Signed and Sealed this

*Second* Day of *April 1985*

[SEAL]

*Attest:*

DONALD J. QUIGG

*Attesting Officer* *Acting Commissioner of Patents and Trademarks*